US008893599B2

(12) United States Patent
Reifenhaeuser

(10) Patent No.: US 8,893,599 B2
(45) Date of Patent: Nov. 25, 2014

(54) METHOD FOR CUTTING A FOOD STANDARD INTO SLICES

(76) Inventor: Uwe Reifenhaeuser, Flammersfeld (DE)

( * ) Notice: Subject to any disclaimer, the term of this patent is extended or adjusted under 35 U.S.C. 154(b) by 0 days.

(21) Appl. No.: 13/373,089

(22) Filed: Nov. 3, 2011

(65) Prior Publication Data

US 2013/0061729 A1 Mar. 14, 2013

(30) Foreign Application Priority Data

Nov. 3, 2010 (DE) ..... 10 2010 060 325

(51) Int. Cl.
*B26D 7/06* (2006.01)
*B26D 7/32* (2006.01)

(52) U.S. Cl.
CPC ..... *B26D 7/32* (2013.01); *B26D 2210/02* (2013.01); *Y10S 83/932* (2013.01)
USPC ..... 83/23; 83/29; 83/92; 83/932

(58) Field of Classification Search
USPC ..... 83/29, 84, 86, 94, 77, 88, 490, 23, 155, 83/155.1, 90–92.1, 932
See application file for complete search history.

(56) References Cited

U.S. PATENT DOCUMENTS 1,993,586 A * 3/1935 Bech ..... 83/88
2,528,888 A * 11/1950 Klingens ..... 83/92
2,563,120 A * 8/1951 Klingens et al. ..... 83/94
3,318,351 A * 5/1967 Werder ..... 83/92
3,905,259 A * 9/1975 Spooner ..... 83/77
3,965,783 A * 6/1976 Muller et al. ..... 83/88
4,405,186 A * 9/1983 Sandberg et al. ..... 414/21
4,545,447 A * 10/1985 Spooner et al. ..... 177/165
4,760,765 A * 8/1988 Nishimoto et al. ..... 83/92
5,107,731 A * 4/1992 Kent ..... 83/91
5,628,237 A * 5/1997 Lindee et al. ..... 83/403.1
5,704,265 A * 1/1998 Johnson et al. ..... 83/77
5,775,190 A * 7/1998 Terai ..... 83/92
5,787,776 A * 8/1998 Nishimoto ..... 83/76.7
6,152,004 A * 11/2000 Nispel ..... 83/92
2003/0145700 A1* 8/2003 Lindee ..... 83/29
2004/0016331 A1* 1/2004 Wolcott et al. ..... 83/23

* cited by examiner

*Primary Examiner* — Sean Michalski
*Assistant Examiner* — Jonathan G Riley
(74) *Attorney, Agent, or Firm* — Von Rohrscheidt Patents

(57) ABSTRACT

A method for cutting a food strand into slices, including the steps of feeding the food strand forward to a cutting device including a rotating blade, successively cutting off slices, placing the cut off slices onto an intermediary storage device moveable transversal to the feed direction and in feed direction in order to form a portion, wherein a stacked or fish scaled slice arrangement with a total of n slices is generated and n is a natural number≥3, transferring a non-finished portion including m slices, wherein m is a natural number and m<n, in its entirety from the intermediary storage device to a conveying device, wherein the slices are extracted through the conveying device, wherein the transferred portion after being transferred to the conveying device is completed by cutting off and adding at least one additional slice and is subsequently extracted.

11 Claims, 15 Drawing Sheets

METHOD FOR CUTTING A FOOD STANDARD INTO SLICES

RELATED APPLICATIONS

This application claims priority from German application DE 10 2010 060 325.2 filed on Nov. 3, 2010, which is incorporated in its entirety by this reference.

FIELD OF THE INVENTION

The invention relates to a method for cutting a food strand into slices including the steps of:

a) feeding the food strand forwards at a feed velocity to a cutting device having a rotating blade;

b) successively cutting off slices with the cutting device from the food strand at a forward end in feed direction during feeding;

c) placing the cut off slices onto an intermediary storage device moveable transversal to the feed direction and in the feed direction in order to form a portion after cutting the slices off from the food strand, wherein a stacked or fish scaled slice arrangement with a total of n slices is generated and n is a natural number greater than or equal to 3;

d) moving the intermediary storage away from the cutting device with feed velocity; and e) transferring a non-finished portion including m slices, wherein m is a natural number and m<n, in its entirety from the intermediary storage device to a conveying device, wherein the slices are extracted through the conveying device, wherein the transferred portion after being transferred to the conveying device is completed by cutting off and adding one additional slice and is subsequently extracted.

BACKGROUND OF THE INVENTION

DE 197 13 813 C1 discloses a method in which a transfer of a partial portion from the intermediary storage which is configured as a fork is provided to a feed device which is configured as a conveyor belt. The feed device is moveable relative to the cutting device, in particular relative to its blade in vertical direction. Transferring a partial portion from the intermediary storage device to the conveying device is provided so that the intermediary storage device continuously moves away from the cutting device with the feed velocity and penetrates with its tongs into the intermediary spaces between adjacent drive belts of the conveying device. Thus the storage conditions, this means the vertical distance between the cutting plane and the top side of the slice that has been cut off last and already stored is being maintained constant. After transferring the partial portion to the conveying device it is required for keeping the storage conditions constant that the conveying device moves away with feed velocity from the cutting device while cutting off the slices that are still missing to form a complete portion. The feed device only stops this lowering process when the last slice of a portion has been cut off and deposited. Thereafter the horizontal extraction of the completed portion is initiated and the intermediary storage device that has been moved into its idle position in the mean time can be moved back into the cross section of the food strand in order to start receiving the next partial portion slice by slice.

It is disadvantageous for the known method that the intermediary storage device and also the feed device have to be synchronized in their vertical movements with the feed movement of the food strand in vertical direction. This places stringent requirements on the type of drives and on the control. In particular the point in time of the transfer when the partial portion switches from being placed on the intermediary storage to being placed on the feed device has to be determined precisely.

Another method is furthermore known from, for example, U.S. Pat. No. 3,842,692. The device as disclosed in this printed document in FIGS. 10 to 14 includes two intermediary storage devices which are transferrable from opposite directions from respective idle positions adjacent to the food strand cross section into their receiving positions below the food strand. The intermediary storage devices that are also moveably supported in feed direction in addition to a direction perpendicular to the feed direction are used in the known method to respectively receive a complete portion of the cut off slices in a form vertically stacked on top of one another in order to transfer them with a transfer element connected there between to a conveying device including a plurality of circumferential belts. The transfer element enters from the bottom side of the conveying device facing away from the food strand into intermediary spaces between adjacent belts and also penetrates intermediary spaces in the fork shaped intermediary storage device in order to approach the bottom side of the formed portion and in order to be able to receive them in a supporting manner.

The two intermediary storage devices are being used in order to be able to provide feeding of the food strand continuously, this means continuously without interruptions when transporting out completed portions. While one portion is still on the first intermediary storage device or is just being taken over by the transfer element, the second intermediary storage device is already in an idle position or in a receiving position moved under the cross section of the food strand, so that the cutting process can be continued without interruption.

This does not only provide advantages with respect to the cutting performance which is accordingly high based on the continuity of the cutting process, but also avoids interrupting the feed movement which is always critical. Deviations in the feed velocity, in particular a short term stoppage of the food strand leads to problems in the feed device due to vibrations namely in particular for softer and deformable foods (e.g. pork sausage, meat loaf, ham, sausage, cheese etc.). Due to calibrations nozzles shortly above the blade the feeding of the food strand has high friction. Additionally, there is a so called "slip stick effect" this means when undercutting a particular feeding force the food strand suddenly breaks loose, this means uneven feeding of the food strand occurs. Due to the strong dynamics of all movements longitudinal vibrations at the knife side end of the material strand cause the food strand to protrude by a small amount below the blade plane in spite of a wanted stop, which leads to cutting off small food pieces (snipping effect). In particular for self service packages using clear foil as packaging material slice fragments of this type are not acceptable since they are perceived as substantial optical deficiency. Providing a continuous feeding without interruption is therefore an essential prerequisite for obtaining high cutting performance and in particular first class cutting quality so that the cut off slices always have an identical geometry.

Whereas the latter problem has been solved for the method according to U.S. Pat. No. 3,842,698, its design complexity is high and the control algorithms for controlling the movements of the many device components are complex.

BRIEF SUMMARY OF THE INVENTION

It is the object of the invention to provide a method for cutting a food strand into slices, wherein high cutting performance and high geometrical precision of the cut off slices can be implemented with low design complexity.

The object is achieved through a method as recited supra in that after transferring the unfinished portion onto the feed device a distance between a top side of the last cut off slice and a bottom side of the blade is successively reduced with each additional slice produced. The invention is based on the finding that the storage conditions for generating portions with high geometric precision are not only optimum or acceptable for a particular distance, but also that the function of the placement quality over the distance between the bottom side of the blade and the top side of the slice placed last extends very flat in the range of the optimum distance. This means that the distance between the bottom side of the blade and the top side of the partial portions already formed can be varied within particular limits without the storage quality being significantly impaired. The invention uses this finding in that in the end phase of producing a portion, this means after transferring a partial portion from the intermediary storage device to the conveying device the distance between the top side of the partial portion and the bottom side of the blade is not kept constant any more through an active vertical movement of the conveying device but that after transferring the partial portion onto the conveying device an increase of the height of the partial portion is permitted until the final stacking height is reached.

According to the method according to the invention a vertical adjustment of the partial stack is only performed during the phase in which the partial stack is still on the intermediary storage. Only the intermediary storage device therefore has to be capable to change its position in vertical direction as a function of the feed velocity. On the other hand side a vertical position change of this type is not performed any more after the transfer onto the conveying device is performed so that with a further increase of the portion height the distance between the top side of the portion and the bottom side of the blade is successively reduced with each additional slice. As already stated supra a reduction of the distance of this type does not lead to a perceivable deterioration of the storage quality when the distance previously was slightly greater that the "optimum distance" and through producing the last slice was only slightly smaller than the "optimum distance".

Another prerequisite for obtaining sufficient cutting quality with the method according to the invention is the fact that the number of the slices which are cut off after the partial portion is transferred to the feed device does not exceed a particular number. Exceeding a particular number, however, is not required according to the method according to the invention since only a certain number of slices still have to be cut off after transferring the partial portion to the feed device, wherein the number of slices is required for moving the intermediary storage device back into the idle position. Thus while a synchronous movement of food strand and intermediary storage device can be provided maintaining constant storage conditions while the partial portion is formed on the intermediary storage device the distance to the conveying device standing still in vertical direction is successively reduced with each added slice after the partial portion is transferred.

According to an advantageous embodiment of the method according to the invention the intermediary storage device is moved away from the cutting device after storing m slices on the intermediary storage device with a velocity which is greater than the feed velocity of the food strand which transfers the non-finished portion to the feed device, wherein a distance between the blade of the cutting device and the top side of the m-th slice when transferring the non-finished portion from the intermediary storage to the feed device is greater than during cutting off the first m slices.

This way the storage conditions while cutting the first m slices can be kept constant, whereas transferring the non-finished portion to the feed device is performed after a drop of the intermediary storage into the conveying device with maximum dynamics. Starting with the point in time of the transfer the distance between the top side of the m-th slice and the bottom side of the blade is then increased and successively reduced with each additional cut off slice up to the n-th slice. It is important that the distance at the point in time of transferring the unfinished portion is sufficiently large in order to be able to receive all slices of the portion which still need to be cut off without a collision between the blade and the top side of the n-th slice occurring.

An embodiment of the method according to the invention includes moving the intermediary storage device so that the respective distance between the top side of the first slice to the m-th slice is greater than the respective distance of the (m+1)-th slice to the n-th slice. In this case the distance between the top side of the portion and the bottom of the blade is only minimal at the point in time when the n-th slice, this means the last slice, is cut off, whereas it is greater than cutting off all preceding slices. Thus the intermediary storage device can be moved downward when cutting off the first m slices, this means up to the point in time of transferring the non-completed portion to the conveying device with the feed velocity of the material strand, wherein constant placement conditions are provided during this phase of the cutting process. A successive reduction of the distance between the portion top side and the bottom side of the blade only occurs after the point in time when the portion is transferred to the feeding device. The advantage of this method is that dynamic movements of the loaded intermediary storage device are not necessary.

Furthermore there is also the option to increase the distance between the top side of the partial portion and the bottom side of the blade while cutting off the first m slices. This increase can be performed immediately when producing the first slice but it can also be provided after a particular number of slices have already been cut off and stored. The distance reduction is achieved in that the intermediary storage device is moved away from the blade with a greater velocity than the feed velocity of the material strand. This way it is possible to store the first slice or the first slices with a particularly small distance between the top side of the slice stored last and the bottom side of the blade. This continuous distance increase provides the necessary increased distance at the point in time when the partial portion is transferred in order to provide sufficient reserves for storing the last n−m slices on the conveying device that is standing still in vertical direction. In turn highly dynamic movements of the intermediary storage device can be omitted for this method.

In the method according to the invention thus the storage conditions after transferring a non-completed portion to the feed device are changed voluntarily, thus in a sense that the distance between the cutting plane and the surface of the slice cut off last is successively reduced with each additional slice. This has the advantage that a synchronization of a vertical movement of the conveying device with the feed movement of the food strand is not required. The requirements upon the control and the precision of the conveying device are thus smaller for the methods according to the invention which affects costs favorably.

According to an embodiment of the invention the conveying device stands still at least in vertical direction at the point in time in which the non-finished portion is handed over to it from the intermediary storage device. This helps reducing control complexity and device complexity with respect to the type of the drive of the feed device in vertical direction. When the conveying device stands still in vertical direction it is important at the point in time when transferring the non-finished portion to the conveying device to provide a distance in vertical direction to the cutting plane so that when the conveying device stands still in vertical direction during the entire cutting process, so that sufficient vertical space is provided for storing all slices that still need to be cut off in order to complete the portion (number n−m).

Thus, in this case the distance between the top side of the m-th slice and the blade of the cutting device is a maximum and the distance is reduced again when additional slices are cut off (when the conveying device stands) still in vertical direction, wherein advantageously the storage conditions when cutting off the last, this means the n-th slice of a portion are the same again as they were while cutting off the first m slices of the portion.

The method according to the invention thus leads to a change in the storage conditions during a transition time in order to thus gain time for bringing back the intermediary storage device. This gains time namely through the accelerated lowering and the "premature handover" of the non-finished portion to the feed device measured by the vertical distance, wherein the time gain can be used for moving the intermediary storage device back into its idle position in order to be able to insert the intermediary storage device in a timely manner back into the food cross section or its projection into the cutting plane when beginning to generate the next portion.

An improvement of the method according to the invention is characterized in that the distance between the blade of the cutting device and a surface of the cutting device before beginning the cutting process as a function of the number n of the slices of the portion to be produced and a thickness d of a particular slice is adjusted. In particular the recited vertical distance is determined from the multiplication of the number n of the slices and their thickness d plus a distance $A_0$ which provides safe clearance for the blade and typically is in a range of a few millimeters.

During tests it has become apparent that it is favorable in particular when the number n of the slices of a completed portion is greater by 2 to 4, advantageously by 3 than the number n of the slices of a non-finished portion when it is transferred from the intermediary storage device to the feed device. This facilitates a sufficient time gain in order to move the intermediary storage device back into its idle position after transferring the non-finished portion to the conveying device or to then also move the intermediary storage device back into the food cross section. Thus, it has also become apparent that increasing the storage distance by such an amount as it is required for subsequent generation and storage of two to four or preferably three vertically stacked slices the storage quality is not significantly deteriorated. As a matter of principle a more "premature" transfer of the non-finished portion to the feed device can increase the time available for moving the intermediary storage device back, wherein however the storage conditions are increasingly deteriorated through stronger vertical lowering of the unfinished portion with an increasingly earlier transfer, at least when the conveying device stands still in vertical direction. The recited number n−m=3 of slices which still have to be produced after the transfer to finish the respective portion thus has proven to be an ideal compromise.

Thus, the method according to the invention omits the transfer element known from U.S. Pat. No. 3,846,698 and therefore substantially reduces manufacturing complexity. Thus, a direct transfer of the partial portion to the feed device is provided without using other components there between. Not only the engineering complexity is reduced, but the invention also simplifies control when implementing a device according to the new method since the complex adjustment between intermediary storage device and transfer element on the one hand side and transfer element and conveying device is reduced to an adjustment between intermediary storage device and conveying element.

Producing a finished portion is provided in two phases according to the method according to the invention, namely one phase in which the intermediary storage device is initially used as a support device for the portion being produced. After a particular amount of time, this means producing a particular number of slices of the portion currently being produced the portion is placed on the feed device during the ongoing cutting process, this means in particular also when the feeding is continued unchanged and the rotation of the blade is unchanged which is not critical, because the storage, this means adding additional slices is performed on the top side of the portion, whereas changing the support from the intermediary storage device to the feed device is performed on the bottom side and therefore can be configured so that it does not cause any interferences on the top side of the portion being created.

A particularly simple transfer of the cut off slices from the intermediary storage device to the feed device is facilitated when the support elements of the intermediary storage device penetrate the intermediary spaces between adjacent belts of the feed device during transfer, wherein a surface of the support elements which supports the slices is arranged below a surface of the belts of the conveying device after the transfer. Through the penetration a change of the support of the slices occurs from the intermediary storage device to the feed device.

In another embodiment of the invention it is proposed that the intermediary storage device performs a movement including translatoric movement sections along a closed path, wherein the intermediary storage device:

- is moved starting from an idle position in which it is located outside of a projection of the cross section of the food strand into a plane orthogonal to the longitudinal axis of the food strand and including the surface of the support elements,
- is moved essentially parallel to the recited plane into a first receiving position in which a first slice of a new portion is received,
- is subsequently successively moved into subsequent receiving positions in which it is moved for generating the respectively desired storage pattern of the slices and for receiving the respective subsequent slice relative to the preceding receiving condition in feed direction of the food strand and/or perpendicular to the feed direction of the feed strand,
- assumes an emptying position after receiving a predetermined number of slices in which emptying position the intermediary storage device and the conveying device viewed in feed direction have moved relative to one another far enough so that the slices have lost contact to the surface with the support elements and instead have entered contact with the surface of the belts of the conveying device, and
- is eventually transferred back into the waiting position without contacting the plane of the surface of the belts of the conveying device in the portion of the belts.

Transferring the cut off slices from the intermediary storage device to the conveyor belt can be advantageously provided through a relative movement in feed direction between the intermediary storage device and the conveying device. Thus, the intermediary storage device is lowered accordingly for an advantageously still standing conveying device.

During cutting operations when producing simple vertical (non-fish scaled) slice stacks the conveying device or before that also the intermediary storage device is lowered by the thickness dimension of the slice for each newly added slice successively or with a corresponding mean velocity continuously per section in order to provide a constant distance between the cutting plane of the blade and the storage surface for the newly created slice during the entire cutting process, wherein the storage surface is provided in the form of the surface of the intermediary storage device or of the surface of the last slice that has already been cut off.

In order to facilitate a quick insertion of the intermediary storage device in the moment of activating the intermediary storage device for receiving the first slice of a new portion it is helpful that the intermediary storage device with the surface of its support elements is in the same plane as the surface of the last completely cut off slice on the conveying device, wherein the surface is oriented towards the food strand in the idle position of the intermediary storage device. For a continued lowering of the conveying device (continuously or in increments) the exact amount of vertical space is provided above the already cut off and slightly lowered slices in the next moment so that the intermediary storage device can be inserted into the strand cross section transversal to the feed device.

In order to have sufficient time for inserting the intermediary storage device into the strand cross section the intermediary storage device can leave the idle position only when the blade has already started to cut off another slice and is already within the cross section of the food strand. On the particular critical time conditions, this means under a high cutting frequency and an accordingly high cutting performance the intermediary storage device during its movement into a projection of the cross section of the food strand in a plane orthogonal to the feed direction can even lift a portion of the slice that is currently being produced, wherein the portion already hangs down due to gravity or even contacts the previously cut off slice, wherein the lifting is performed with the surface of the support elements of the intermediary storage device. This way a starting storage of the newly produced slice on the slices of the preceding portion is reversed again through transferring the intermediary storage device into the receiving position in order to associate the currently produced slice with the new portion, this means with the intermediary storage device.

According to another embodiment of the method according to the invention the intermediary storage device penetrates from one side into the cross section of the food strand and the blade of the cutting device penetrates the cross section of the food strand from the opposite side. Thus, collisions between the intermediary storage device to be inserted and a completed portion are prevented on the feed device during transporting. Also the insertion can be time delayed far enough so that downward extending portions of a slice that is being created are lifted off from the inserting intermediary storage device and picked up, wherein precise storage conditions can also be provided for an extreme time based arrangement of this type.

From a device point of view the intermediary storage device advantageously includes support elements which are arranged so that they can be positioned in intermediary spaces between adjacent belts of the feed device, wherein a plane defined by the surface of the support elements extends parallel to a plane defined by the surface of the belts of the feed device. Since the planes are parallel, a transfer of the slices from the intermediary storage device to the belts is configured particularly gentle which provides high quality of the placement geometry. Advantageously the intermediary storage device is configured fork shaped and the supports elements are configured tongue shaped and arranged at a support beam and preferably welded together therewith.

In order to provide high dynamics when moving the intermediary storage device the mass of the intermediary storage device that shall be accelerated quickly shall be kept as low as possible. Therefore, the height of the support elements measured in feed direction shall be smaller than twice the thickness, advantageously smaller and 1.5 times the thickness of the slices to be cut off in particular smaller than 10 mm, advantageously smaller than 8 mm, particularly advantageously shall be between 4 mm and 6 mm. The mass of the intermediary storage device should be less than 0.5 kg advantageously less than 0.3 kg. For a material for the intermediary storage device in particular for the support elements besides stainless steel or aluminum alloys also fiber reinforced plastic material in particular using carbon fibers is suitable.

From a design point of view it is advantageous when the intermediary storage device is moveably supported perpendicular to the feed direction in a receiving frame and the receiving frame is moveably supported in feed direction at a machine frame, wherein the receiving frame includes two linear supports for the intermediary storage device arranged laterally adjacent to the feed device. A receiving frame according to the instant application is not necessarily a closed arrangement of the members. This rather also includes a three sided, this means U shaped arrangement of members which is helpful in order to be able to implement support devices for the intermediary storage device at both sides adjacent to the conveying device. For the linear supports in particular also a drive using a timing belt is suitable, wherein the timing belt provides operation without slippage even for movements with highest dynamics.

Typically the conveying device is followed by an extraction device also configured as a band with a plurality of belts extending parallel to one another. In order to provide a continuous transition between the conveying device and extraction device when moving the conveying device, in particular on the side of the conveying device oriented towards the extraction device, the feed device can be supported at a extraction frame together with an extraction device, wherein the extraction frame is adjustably supported, in particular moveably or pivotably supported at a machine frame.

In order to also be able to implement a fish scaled storage of slices on the intermediary storage device before transferring them to the conveying device the support elements of the intermediary storage device should have a length measured perpendicular to the feed direction which is at least twice the width of the cut off slices measured perpendicular to the feed direction, preferably at least three times the width.

In order to prevent time based problems in the time critical phase of inserting the intermediary storage device, the intermediary storage device starting from its idle position shall be insertable in the same direction into a projection of the cross section of the food strand into a plane which is formed by the support elements of the intermediary storage device, wherein the cut off slices are transportable by the conveying device in the same direction.

It provides further time relief for the cutting process when the intermediary storage device enters from one side into a projection of the cross section of the food strand into a plane which is formed by the surface of the support elements of the intermediary storage device, wherein the surface is opposite to a side where a slice that is being created disengages from the food strand driven by gravity.

BRIEF DESCRIPTION OF THE DRAWINGS

The method according to the invention is subsequently described based on an embodiment of a device with reference to drawing figures and two diagrams, wherein.

DETAILED DESCRIPTION OF THE INVENTION

Figure 1:
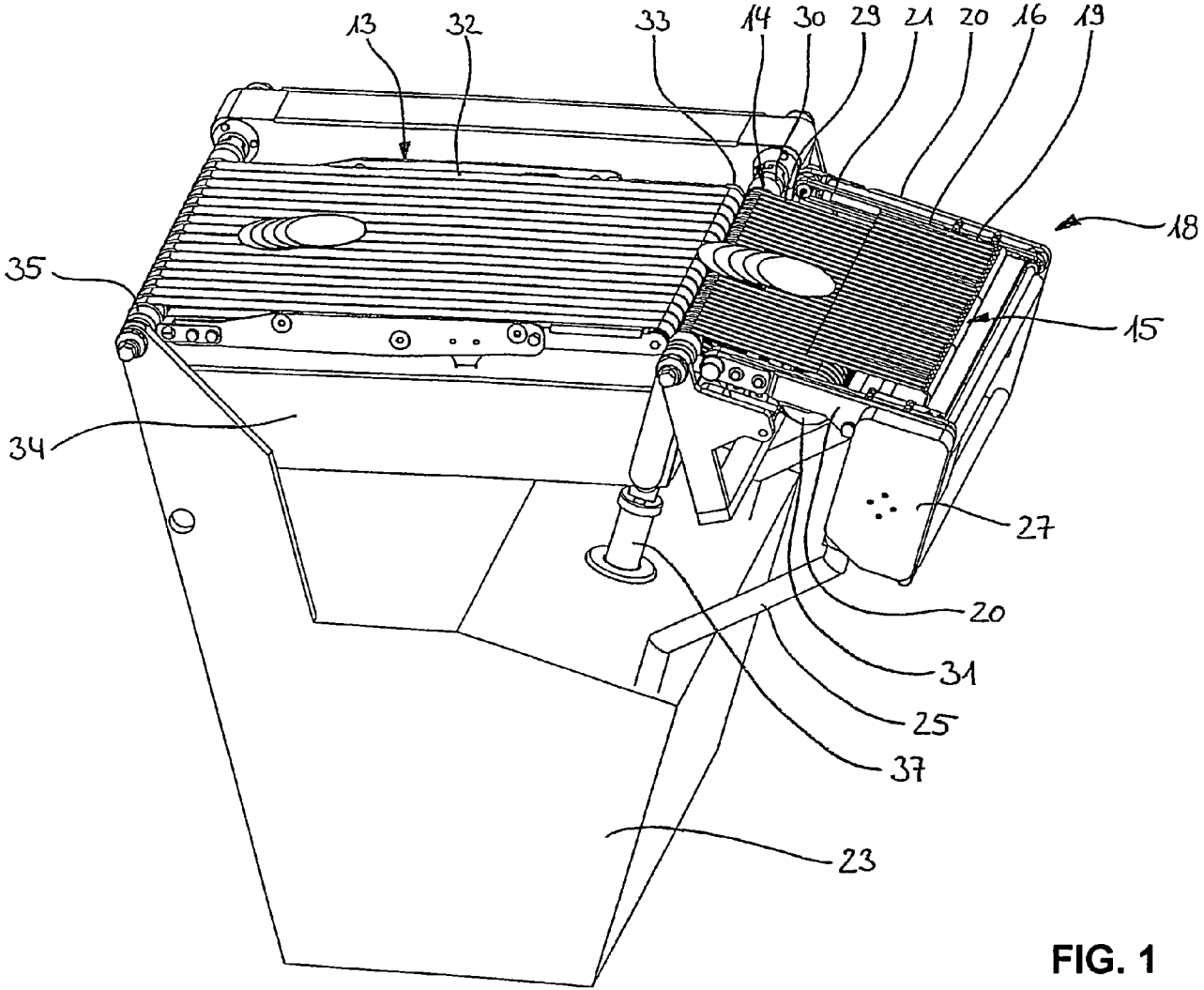
FIG. 1 illustrates a perspective view of a portion of a device for cutting a strand shaped food material with a completed portion including fish scaled slices on a conveying device and with an intermediary storage device in an idle position.

A device 1 for cutting a food strand 2 (e.g. sausage, cheese etc.) illustrated in FIGS. 1 through 5 in details in a perspective view and in FIGS. 6 through 10 in a lateral view includes a cutting device 3 only illustrated in FIGS. 6-11 which includes a blade 5 rotating about a rotation axis 4, wherein the blade is configured, for example, as a sickle blade, alternatively also configured in the form of a circular blade rotating at a pivot arm like a planetary gear. A cutting edge 6 defines a cutting plane 7 through rotation, wherein the cutting plane is oriented perpendicular to a longitudinal axis 8 of the food strand 2. The longitudinal axis 8 extends in parallel with the feed direction illustrated by an arrow 9 in which the food stand 2 is pushed forward through a feed device 10 which is only schematically illustrated wherein the forward movement occurs towards the blade 5 of the cutting device 3. The feed device 10 includes a gripping device 11 at its upper end, wherein the gripping device is moveable in feed direction (arrow 9), wherein the gripping hooks 12 of the gripping device are dug into the rear end of the food strand 2 oriented away from the blade 5 thus forming a form locked connection. The gripping device 11 and also two feed belts that are not illustrated in detail which laterally support the food strand 2 and are configured as required with form locking devices (spikes) for preventing slippage and have a configuration that is known in the art and do not have to be described in more detail. As a result, the food strand 2 can be moved forward through the feed device 10 with high precision in feed direction (arrow 9) which is important for achieving high precision for the geometry of the slices to be cut off.

On a side of the cutting plane 7 that is oriented away from the food strand 2 and the feed device 10, there are adjacent and partially overlapping with one another an extraction device 10, a conveying device 14 and an intermediary storage device 15. The intermediary storage device 15 is formed as a fork and includes a plurality of support elements 16 that are arranged in parallel and equidistant to one another and configured tongue shaped and a support beam 17 that extends perpendicular to the support elements and is connected therewith. The intermediary storage device 15 is supported in a receiving frame 18, thus so that it is movable perpendicular to the feed direction, this means parallel to the cutting plane 7. Thus, the support beam 17 is supported respectively at both longitudinal ends in a respective linear support 19 which is respectively arranged in the interior of a longitudinal member 20 of the receiving frame 18. The drive of the intermediary storage device 15 in a direction of the linear support devices 19 is provided through a timing belt 21 which is connected with the support beam 17 on both sides of the intermediary storage device 15 through a coupling element.

Figure 6:
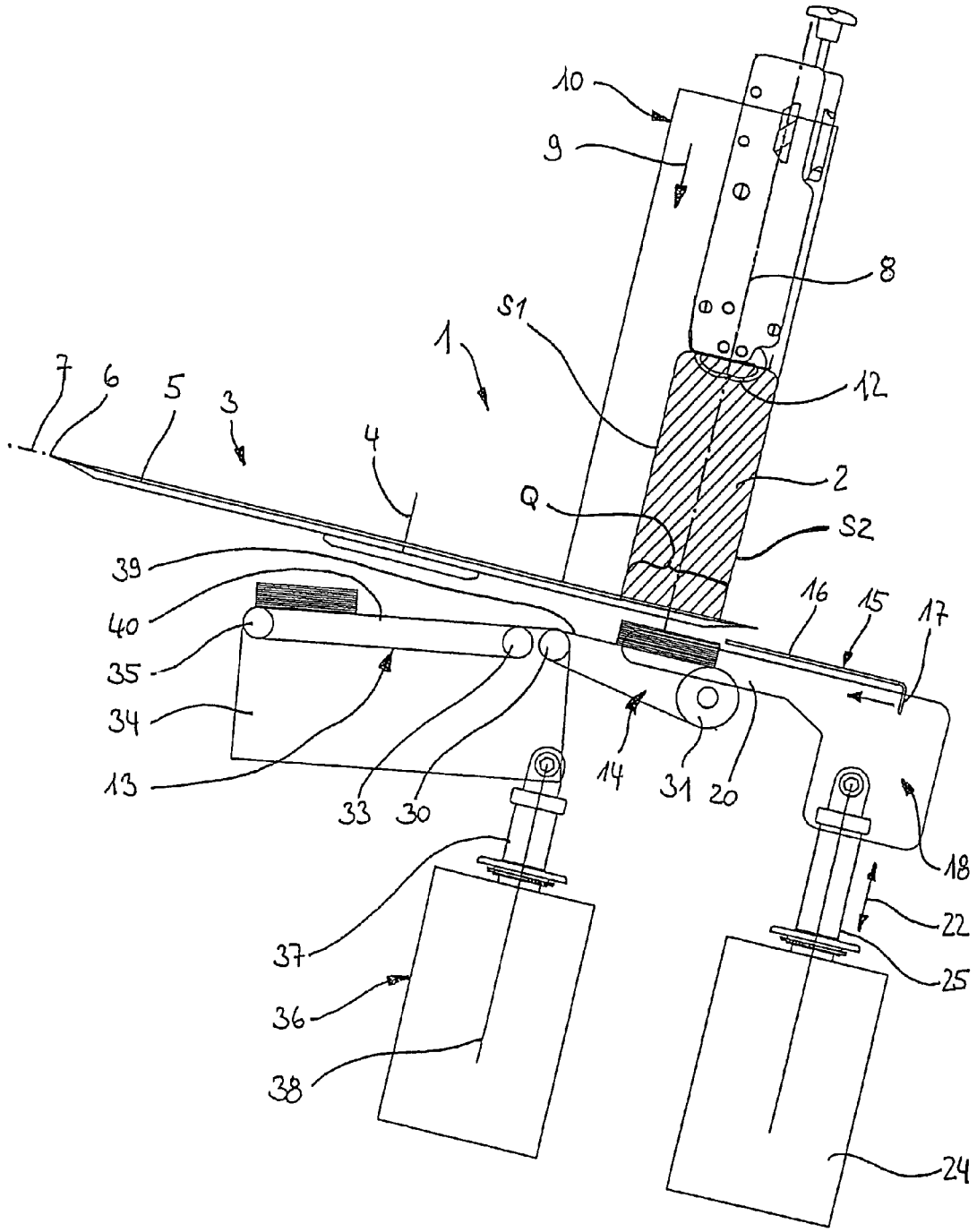
FIG. 6 illustrates a lateral view of the device according to FIGS. 1-5 including the feed device arranged above the conveying device including a food strand arranged therein and the cutting device, wherein a completed portion including stacked slices is arranged on the conveying device and the intermediary storage device is disposed in the idle position.

The receiving frame 18 as such is movable in a direction (double arrow 22) parallel to the feed direction (arrow 9) within a machine frame 23 that is schematically illustrated in FIG. 1 but not illustrated in more detail in FIG. 6. The adjustability is provided, for example, through a cylinder 24 that is activated hydraulically or pneumatically, wherein a bottom component of the receiving frame 18 is connected to the respective piston rod 25 of the cylinder. As apparent from FIG. 1 in which only the piston rods are visible which are configured with an elbow in reality and which are illustrated straight in FIGS. 6 through 11 for simplicity purposes support and adjustment of the receiving frame 18 is provided through two cylinders 24 in FIGS. 6 through 11 (not visible) and two associated piston rods 25 which engage opposite sides of the receiving frame 18. A servo drive for moving the intermediary layer 15 through the timing belts 21 and arranged behind a cover 27 of the receiving frame 18 is not illustrated in the figures.

The conveying device 14 includes a plurality of belts 29 which are arranged equidistant from one another and which form a common conveying plane 28 on their top side, wherein the belts are run about two deflection rollers 30, 31 including ring grooves for the belts 29, wherein one of the deflection rollers is drivable through a servo drive. The inner distance between two adjacent belts is slightly greater than the width of the support elements 16 measured perpendicular to the longitudinal extension of the fork shaped support elements 16. Since the pitch of the belts 29 of the conveying device 14 corresponds to the pitch of the support element 16 of the intermediary storage device 15, the latter can penetrate intermediary spaces between adjacent belts which is important for the transfer of cut off slices from the intermediary storage device 15 to the feed device 14 described infra.

The extraction device 13 like the conveying device 14 includes a plurality of belts 32, whose width is substantially greater than the width of the belts 29 of the conveying device 14. A deflection roller of the extraction device 13 is arranged close enough to the deflection roller 30 of the conveying device 14 so that the belts 29, 32 do not collide with one another, which provides a transfer from the conveying device 14 to the extraction device 13 which does not impair the slice arrangement.

The extraction device 13 is supported in an extraction frame 34 which is pivotably supported in the machine frame 23 about the rotation axis of a deflection roller 35. The end of the extraction device 13 which is associated with the deflection roller 33 of the extraction device 13 is connected in FIG. 1 with an additional cylinder 36 (hydraulically or pneumatically activated) which is covered by the machine housing, but visible in FIG. 6, or its piston rod 37. Extending the piston rod 37 from the cylinder 36 thus causes an upward pivoting of the extraction frame 34 and also a parallel movement of the feed device 14 which is also coupled with the piston rod 37. Due to one longitudinal axis 38 of the cylinder 36 being parallel to the feed direction (arrow 9) and a respective connection of the conveying device 14 with the piston rod 37, a receiving plane 39 of the feed device 14 formed by the surface of the belts 29 always remains aligned in parallel with the cutting plane 7, this means perpendicular to the feed direction (arrow 9). Due to the pivotable connection between the feed device 14 and the extraction device 13, the angle enclosed between the receiving plane 39 and an extraction plane 40 formed by the surface of the belts 32 changes as a function of the position of the feed device 14, this means the position of the piston rod 37 of the cylinder 36. Another timing belt 40 establishes a coupling between the deflection roller 30 of the conveying device 14 and the deflection roller 35 of the extraction device 13.

The method according to the invention is subsequently illustrated in more detail wherein the particular method steps are described with reference to the drawing figures, wherein:

FIGS. 1 through 5 initially illustrate forming portions according to a method that is not performed according to the invention, wherein the portions include five slices that are placed on top of one another in a fish-scale pattern, that means offset from one another. Due to omitting the cutting device 3 and the feed device 10 including the food strand 2, the interaction between the conveying device 14, the intermediary storage device 15 and the extraction device 13 is visible particularly well.

FIG. 1 illustrates a situation in which a portion that is just completed and formed from five slices contacts the conveying device 14. Per blade revolution, one slice is cut off from the food strand 2, wherein the belts 29 of the feed device 14 are moved forward between two subsequent cuts by the amount of the "fish scaling dimension" in a direction towards the extraction device 13 in order to generate a partially overlapping, so-called fish scaled or shingled storage.

FIG. 1 illustrates a situation in which the blade 5 has just finished cutting off the last uppermost slice and the intermediary storage device 15 is still in its idle position in which it has a maximum distance from the extraction device 13 through respective control of the timing belts 21. The height of the receiving frame 18 which is adjustable through the control of the cylinders 24 that are not visible and thus the movement of the associated piston rods 25 and thus also the height of the top side of the support elements 16 of the intermediary storage device 15 at this moment is adjusted so that the intermediary storage device 15 can be moved in a direction towards the extraction device 13 through activating the drive of the timing belt 21 without contacting the uppermost slice of the finished portion lying on the conveying device 14.

Figure 2:
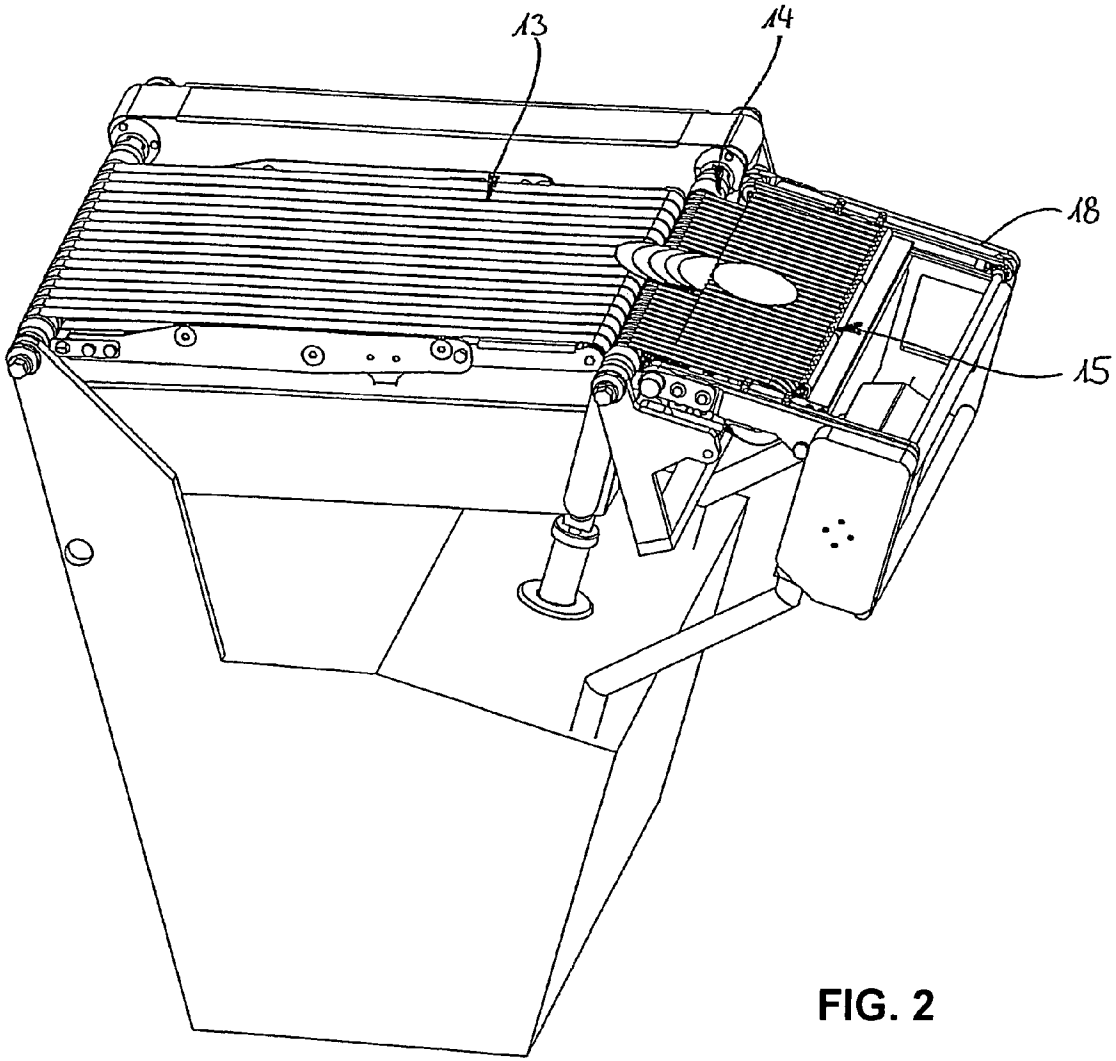
FIG. 2 illustrates a view analogous to FIG. 1 with the completed portion when transferring it from the conveying device to an extraction device and with an intermediary storage device with a cut off slice in a receiving position.
Figure 15:
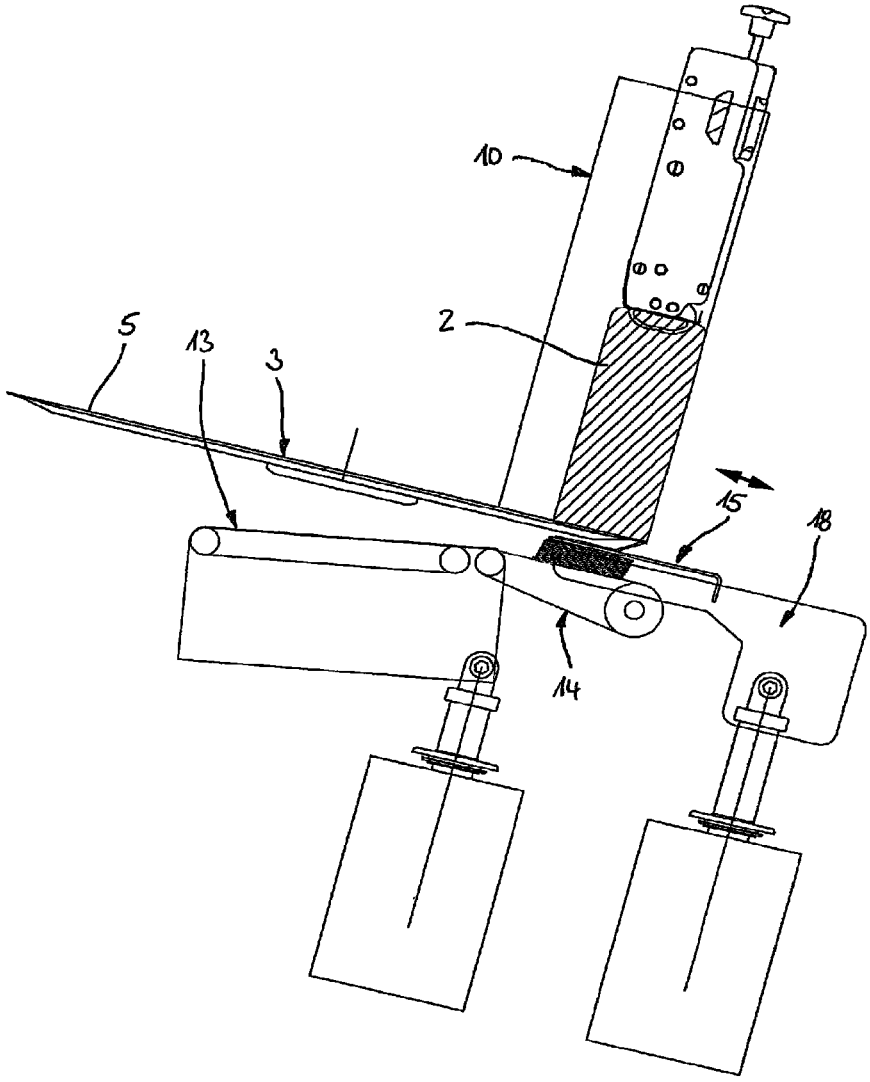
FIG. 15 illustrates the intermediary storage device lifting the downward hanging portion of a slice that is being newly produced before it is completely cut off.

FIG. 2 illustrates the intermediary storage device 15 in its receiving position in which it is arranged vertically below the face of the food strand and can therefore receive a slice that has just been cut off on the top side of its support elements 16. Since the rotation of the blade 5 and also the forward movement of the food strand 2 during the entire cutting process, this means until the food strand 2 besides a residual piece in which the gripper hooks 12 are located is completely cut up, moves with constant speed, this means without a change of angular velocity, the intermediary storage device has to be moved from its idle position into its receiving position between the production of two slices. This requires a high level of dynamics in the movement of the intermediary storage device which is facilitated by a high performance servo drive for the synchronous belts 21. As a matter of principle it is feasible that the slice that is being produced for a new portion hangs down with its cut off portion following gravity, possibly even already contacts the last slice of the preceding completed portion, because the intermediary storage device entering into the gap between the blade and the preceding completed portion can receive or lift the downward hanging or already stored portion of a slice that is being newly produced before it is completely cut off from the food strand 2 so that the new slice is completely and correctly placed on the intermediary storage device 15 as illustrated in FIG. 15. It is furthermore visible in FIG. 2 that the completed portion due to the continued movement of the feed device 14 with its two frontal slices has already reached the extraction device 13 and is disposed in a transfer phase.

Figure 3:
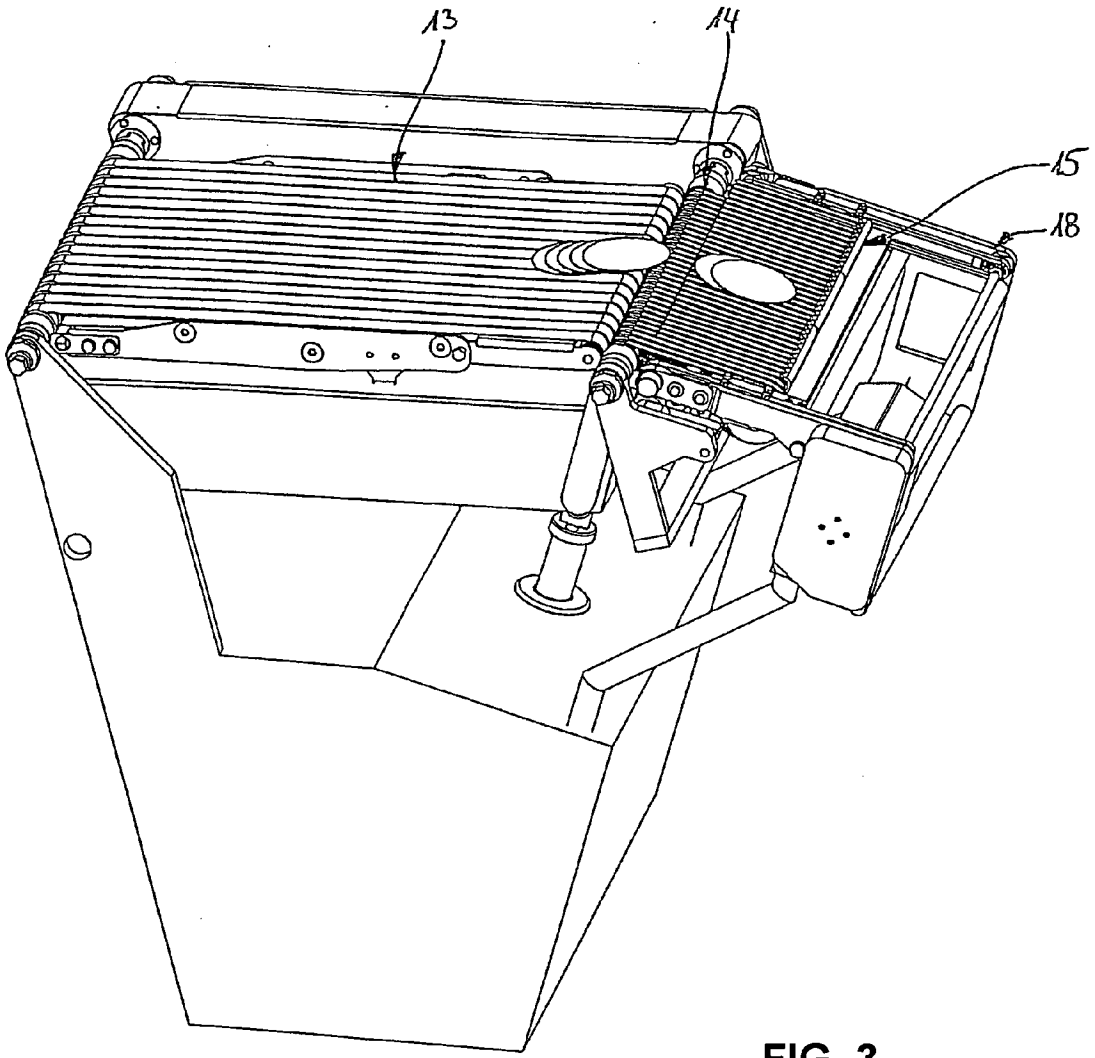
FIG. 3 illustrates a view analogous to FIG. 2, however with the completed portion on the extraction device and with two slices on the intermediary storage device.

It is evident from FIG. 3 that a second slice of the portion currently being formed is cut off and was stored on the intermediary storage device 15. In order to generate a fish scaled storage also on the intermediary storage device, the intermediary storage device has moved forward perpendicular to the feed direction by the fish scaling dimension, so that the second slice only partially overlaps the first slice of the new portion. The conveying device does not move perpendicular to the feed direction. Based on the further continued movement of the conveying device 14 and the extraction device 13, the preceding completed portion is now substantially completely disposed on the extraction device 13.

Figure 4:
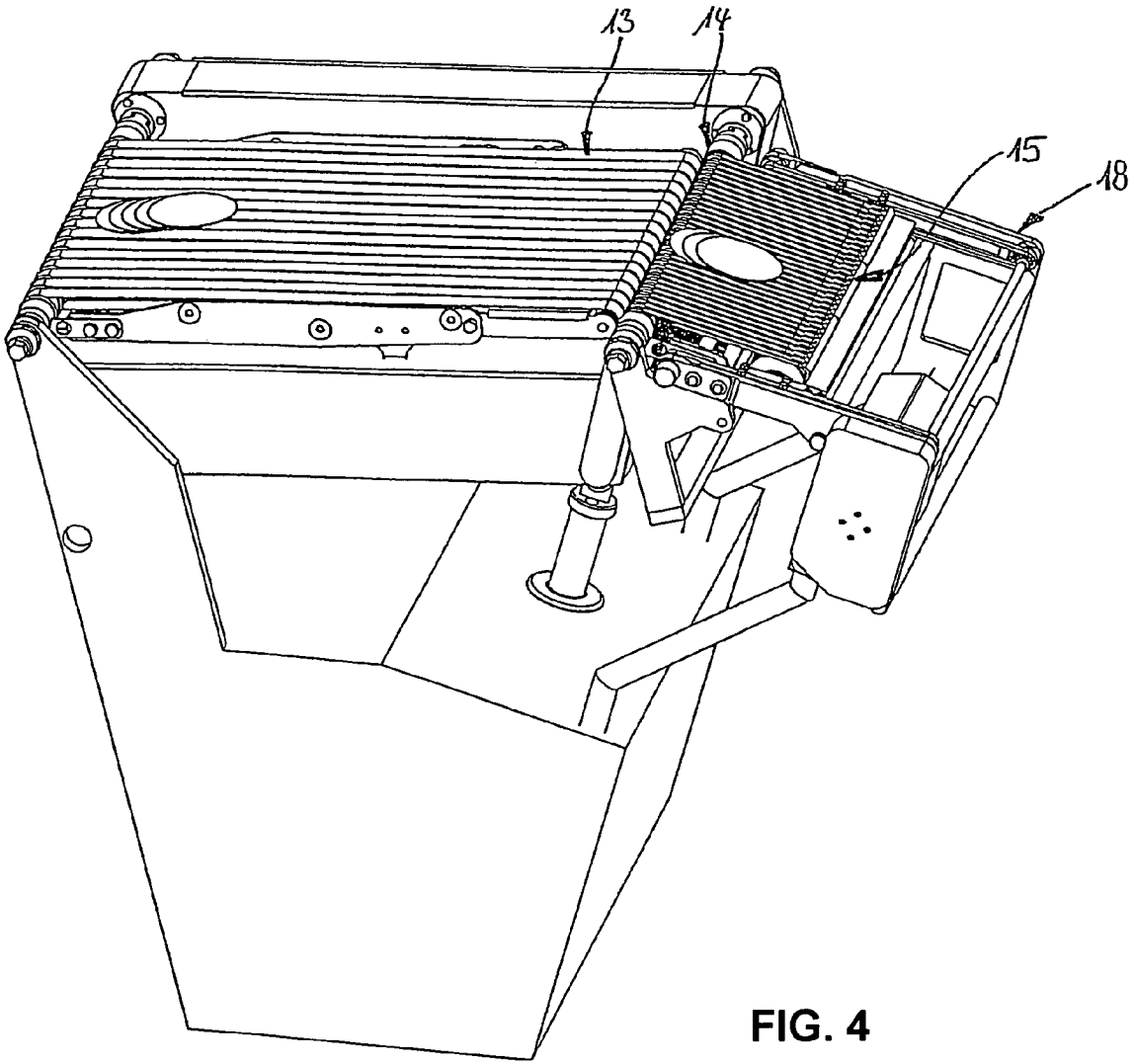
FIG. 4 illustrates view analogous to FIG. 3, however with three slices on the intermediary storage device.

According to FIG. 4, the intermediary storage device 15 is now moved into an emptying position in which the support element 16 penetrates the gaps between two adjacent belts 29 through the downward movement of the intermediary storage device 15 so that the slices that are previously in contact with the support elements 16 of the intermediary storage device 15 are transferred to the surface of the belts 29. Simultaneously with the transfer of the slices to the feed device 14 or time based shortly before or thereafter the third slice of the portion to be newly formed is cut off, wherein the portion was moved forward through respective movement of the intermediary storage device 15 parallel to the feed direction or movement of the conveying device 14 in order to facilitate a continuation of the fish scaled storage. The preceding completed portion has meanwhile moved on the extraction belt 13 further in a direction towards the deflection roller 35 in order to be subsequently forwarded into a packaging device in which the slices are welded into a self service foil package.

Figure 5:
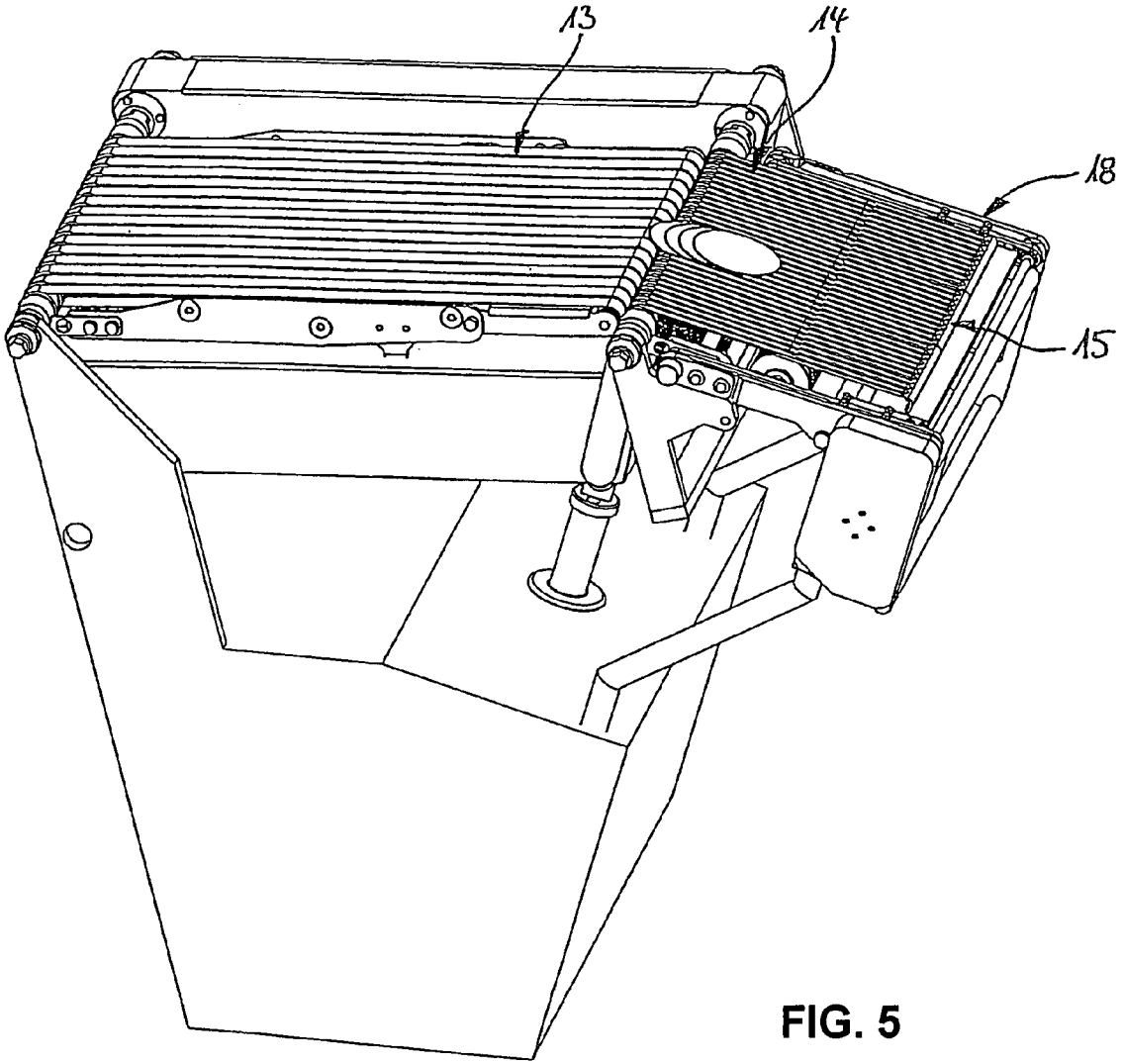
FIG. 5 illustrates a view analogous to FIG. 4, however after transferring a new completed portion to the feed device and with the intermediary storage device in an intermediary position between the emptying position and the idling position.

FIG. 5 shows how a fourth slice is added to the portion currently formed. The portion that is still unfinished thus only contacts the feed device 14 and is moved forward in order to maintain the fish scaling relative to the preceding slice section by one piece towards the extraction device 13. The intermediary storage device 15 was retracted in an intermediary position while maintaining its distance to the cutting plane from the emptying position, wherein any contact with the cut off slices is avoided. Based on the illustrated intermediary position of the intermediary storage device 15, it can be raised in a next step into its idle position again which is performed by raising the entire receiving frame 18. After cutting off another slice, a fifth slice completing the current portion, the starting position according to FIG. 1 is reached again.

Contrary to providing the fish scaled portions according to FIGS. 1 through 5, FIGS. 6 through 11 illustrate the method according to the invention for producing a portion which includes slices that are stacked exactly on top of one another. Also such portions are welded in a packaging device in foil packaging subsequent to the device according to the invention and offered as self service packaging units in supermarkets.

Figure 7:
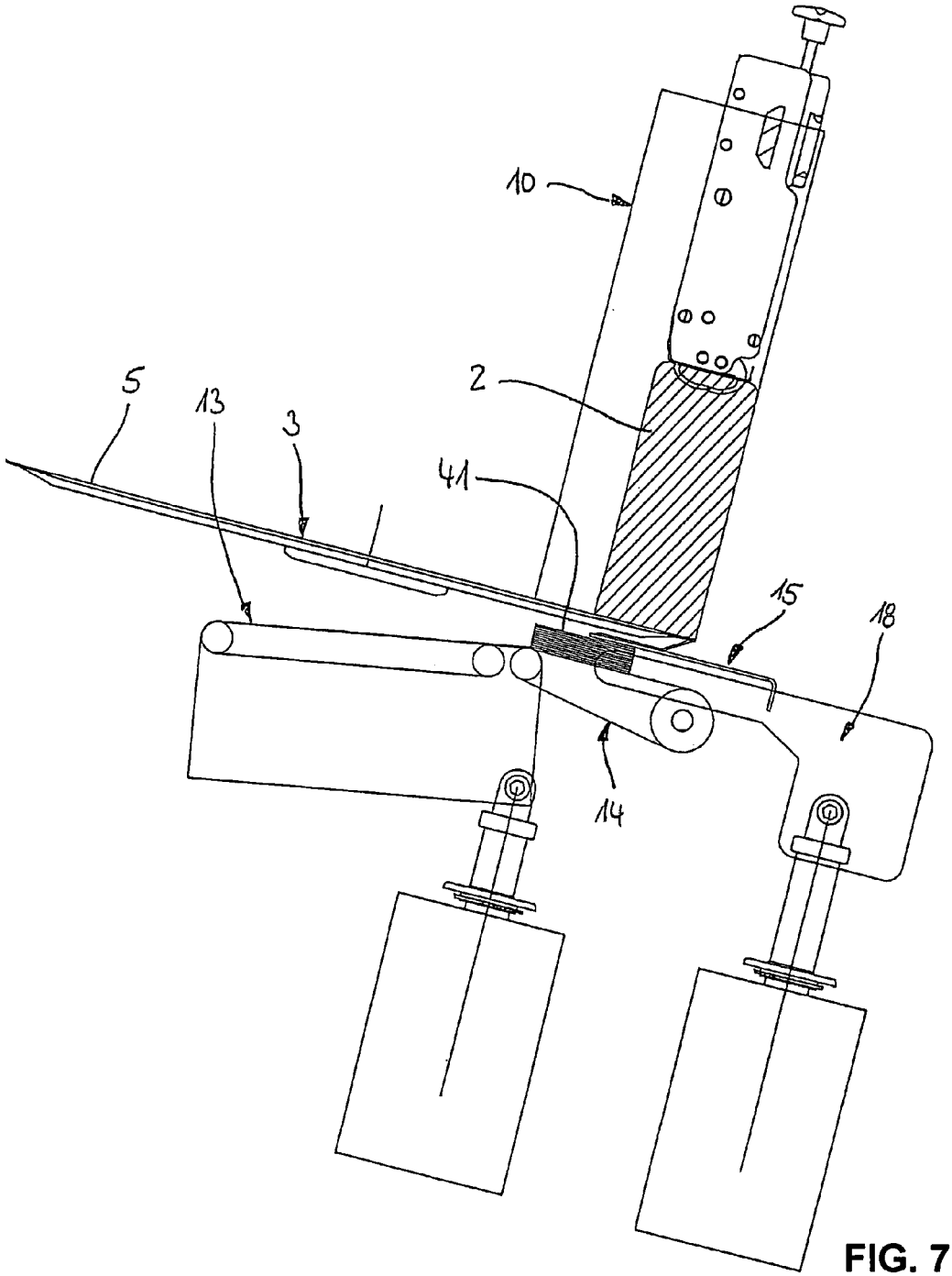
FIG. 7 illustrates a view analogous to FIG. 6, however with the completed portion in a position laterally moved on the conveying device and the intermediary storage device in a first receiving position.

Comparable with the situation according to FIG. 1, FIG. 6 illustrates a completed portion disposed on the conveying device 14, wherein the completed portion in the present case includes a number of n=12 slices. The blade 5 is still disposed within the cross-section of the food strand 2, however will depart the food strand in the next moment in order to subsequently penetrate again by some distance into the food strand 2 moved forward by a portion in between in order to start cutting off the next slice. At this particular point in time, the intermediary storage device 15 is transferred from the idle position illustrated in FIG. 6 into the receiving position illustrated in FIG. 7, this means inserted with high dynamics. Thus, at the beginning of generating the next slice, the next slice is stored on the intermediary storage device 15 which is only slightly above the surface 41 of the completed portion in its inserted position (receiving position). Also when cutting off slices which as illustrated in FIG. 7 are initially stored on the intermediary storage device 15, the principle is applied that the free end that hangs down due to gravity of a slice that is being created is already placed on the surface of the intermediary storage device 15 or the surface of slices already previously placed there, before the slice is completely cut off from the food strand 2. This known method has the advantage that the storage quality is very good, since the slice is never in free fall, this means without contact either with the food strand 2 or the storage device. Uncontrolled throwing around of cut off slices as this would be unavoidable for a greater drop distance of the slices is safely prevented by this method. It is furthermore apparent from FIG. 7 that the completed portion was already moved by a certain amount towards the extraction device 13 through the horizontal movement of the conveying device 14.

Figure 8:
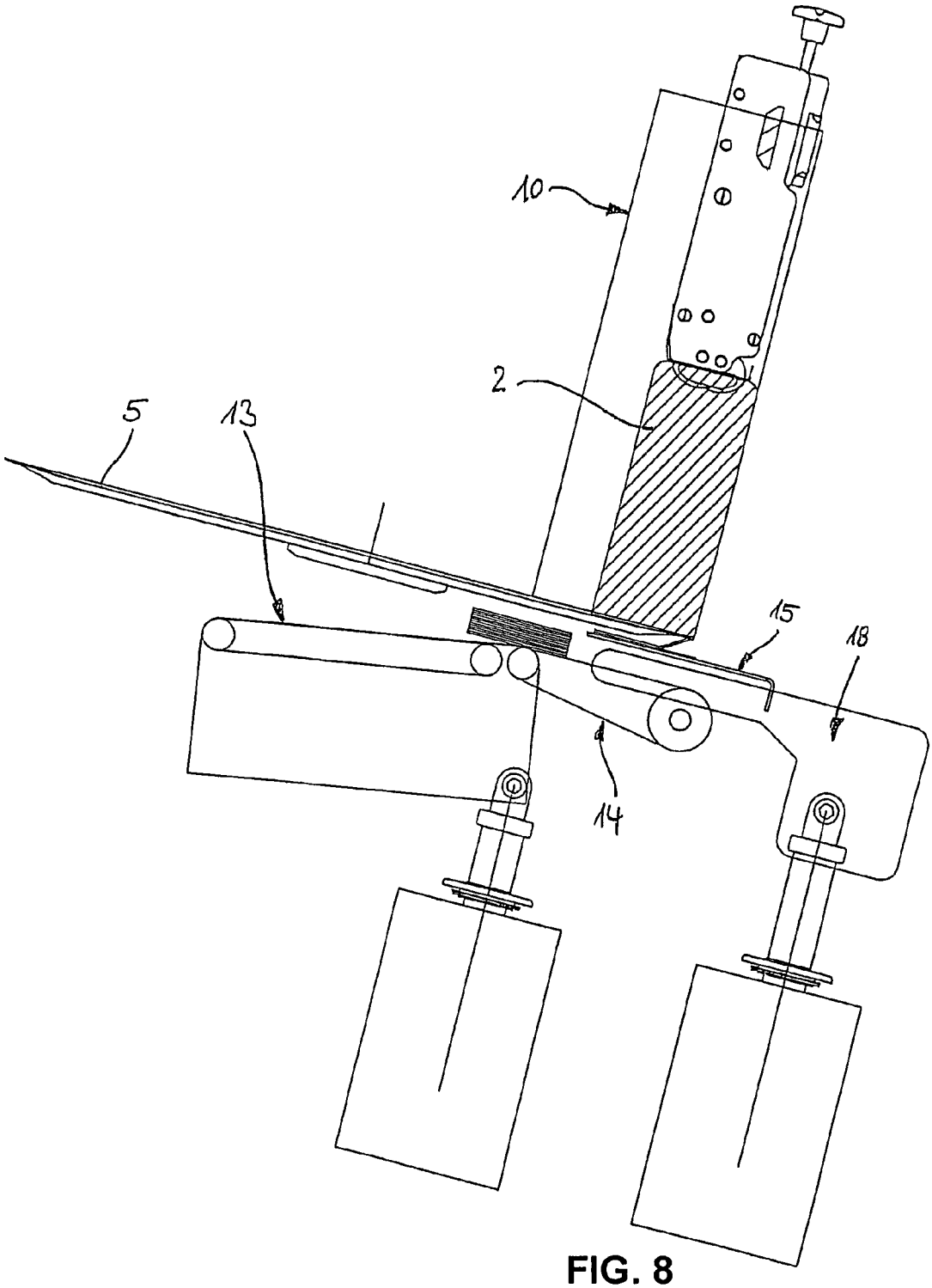
FIG. 8 illustrates a view analogous to FIG. 7, however with the finished portion when transferring from the conveying device to the extraction device and with the intermediary storage device in a second receiving position.

FIG. 8 illustrates a situation where the second slice of the portion to be newly formed is just before being completely cut off from the food strand 2. Differently from the fish scaled storage according to FIGS. 1 through 5, the vertically stacked storage according to FIGS. 6 through 11 only requires that the intermediary storage device 15 has to be moved in feed direction while it is being used for storage in order to keep the distance between the cutting plane defined by a cutting edge of the blade 5 and the storage plane for the next slice that is being created constant and thus also not to change the storage conditions. The portion previously completed in the situation illustrated in FIG. 8 is in a transfer portion between the conveying device 14 and the extraction device 13.

Figure 9:
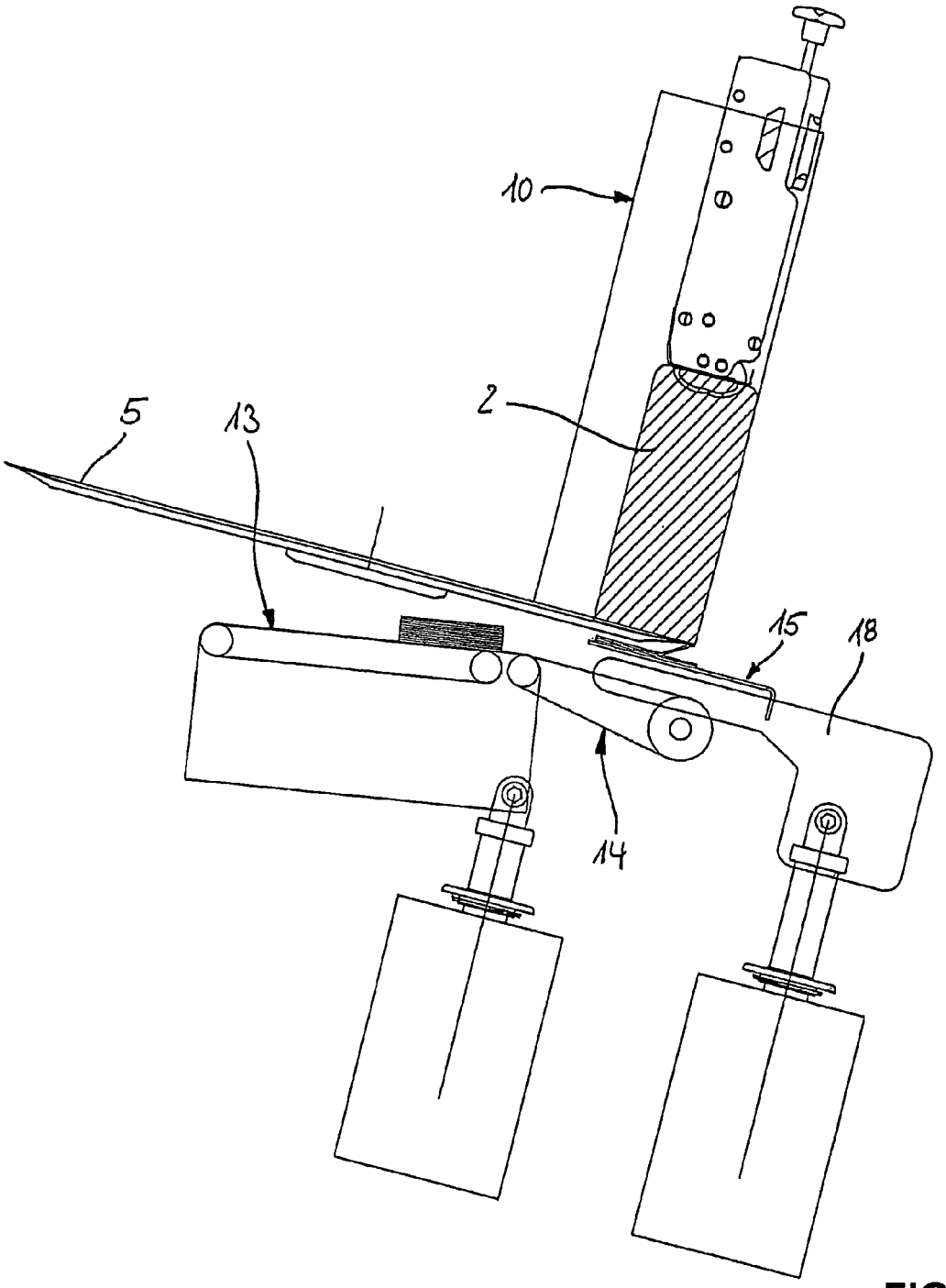
FIG. 9 illustrates a view analogous to FIG. 8, however with the finished portion on the extraction device and the intermediary storage device in a third receiving position.

In FIG. 9 it is illustrated how the third slice of the portion that is being newly formed is cut off. The preceding completed portion is transferred to the extraction device 13 and is moved further forward from there.

Figure 10:
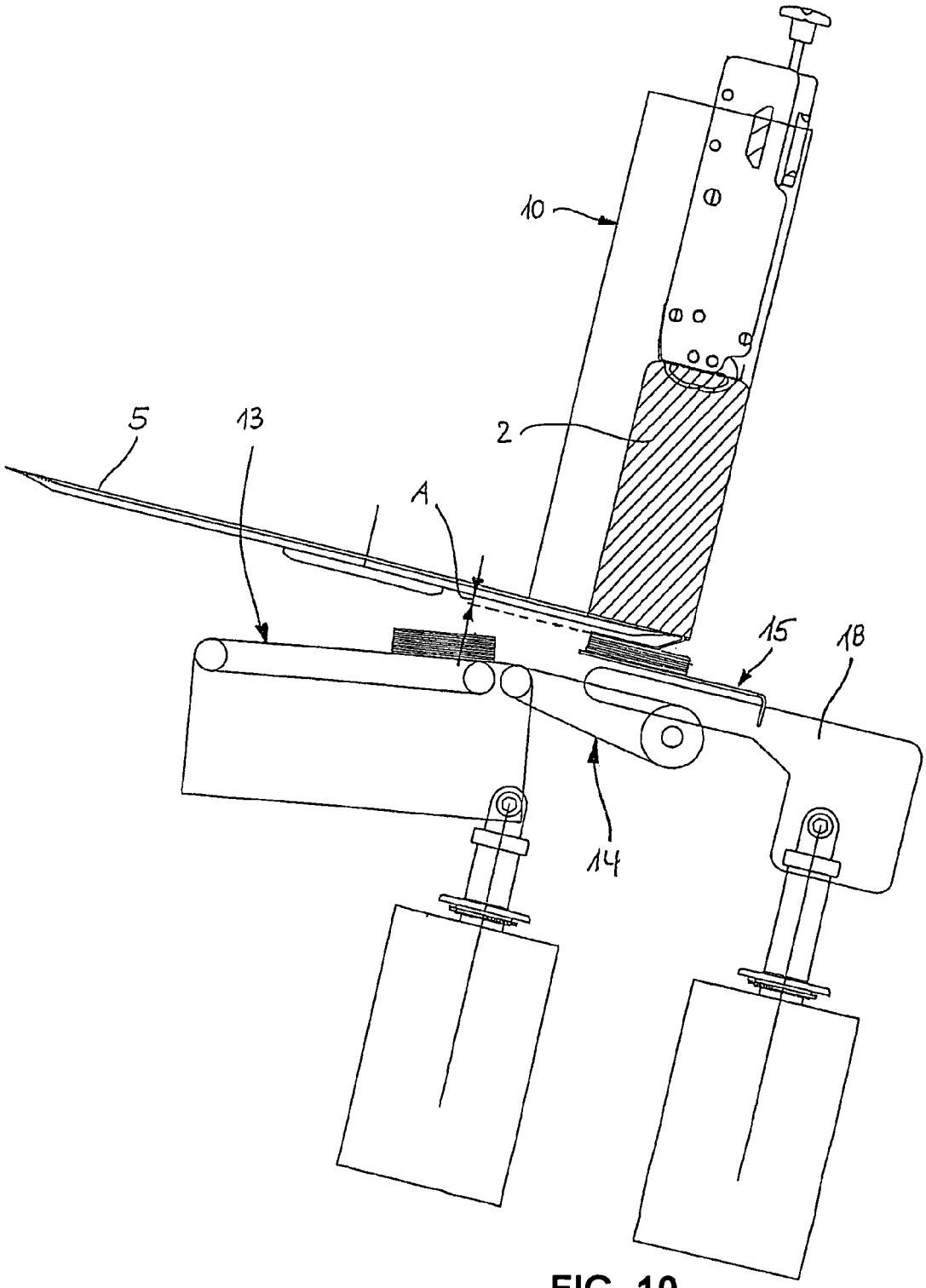
FIG. 10 illustrates a view analogous to FIG. 9, however with the finished portion in a moved position on the extraction device and the intermediary storage device in a fourth receiving position.

FIG. 10 illustrates a condition in which nine of the twelve slices of a portion are cut off from the food strand. The storage conditions in this moment are the same as they were at the beginning of the production of the portion that is just being produced. The distance A is provided between the bottom side 43 of the blade 5 and the top side 42 of the slice cut off last.

Figure 11:
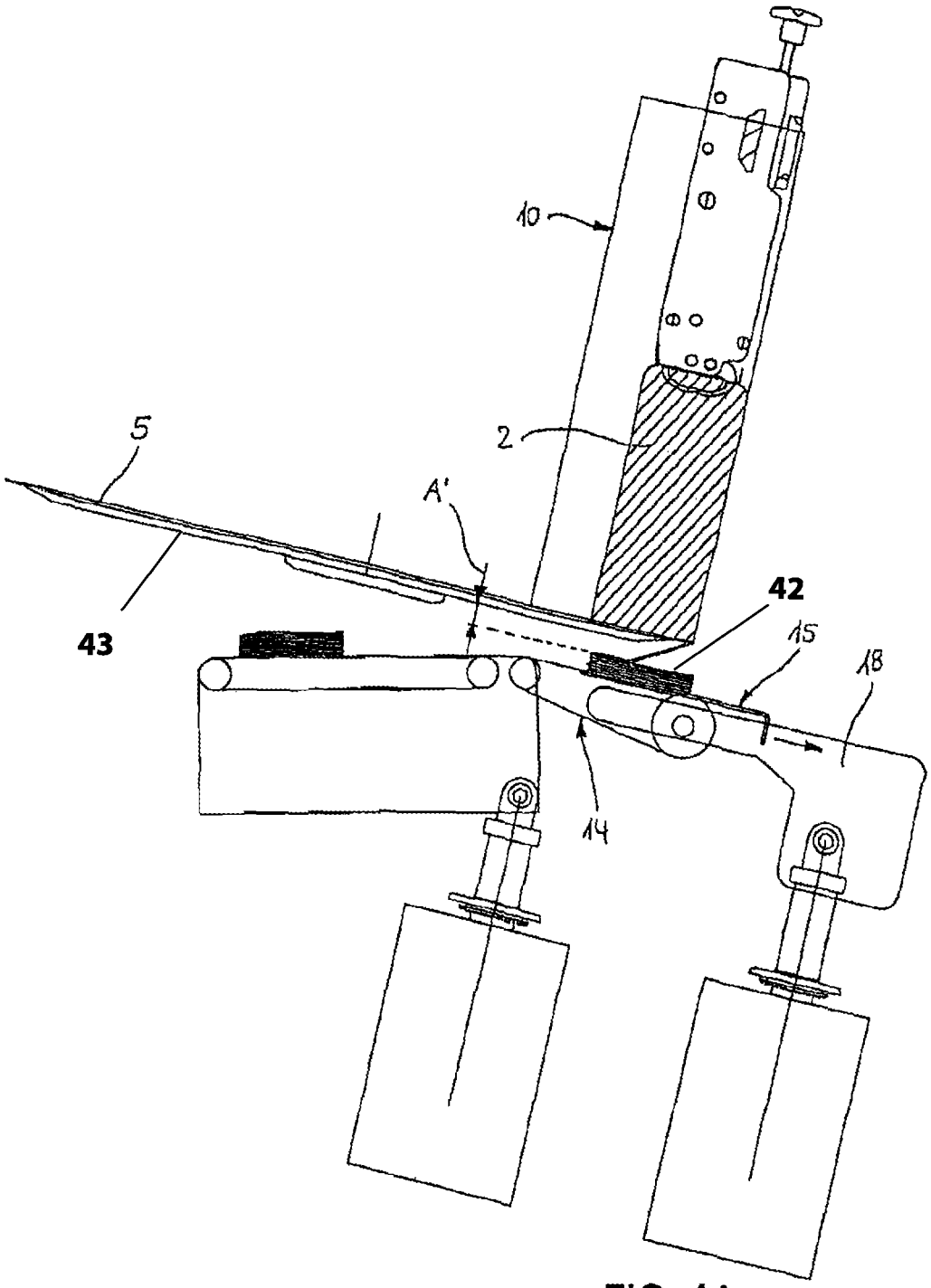
FIG. 11 illustrates a view analogous to FIG. 10, however with a partial portion to be transferred still arranged on the intermediary storage device that is lower by a greater amount.

On the other hand side, FIG. 11 illustrates a condition that was generated through accelerated lowering of the intermediary storage device 15, wherein the forks of the intermediary storage device 15 are inserted between the belts of the conveying device 14 so that the non-finished portion now contacts the conveying device 14 and does not contact the intermediary storage device 15 anymore. The present distance A' between the bottom side 43 of the blade 5 and the top side 42 of the slice cut off last is greater than the distance A previously provided.

Figure 12:
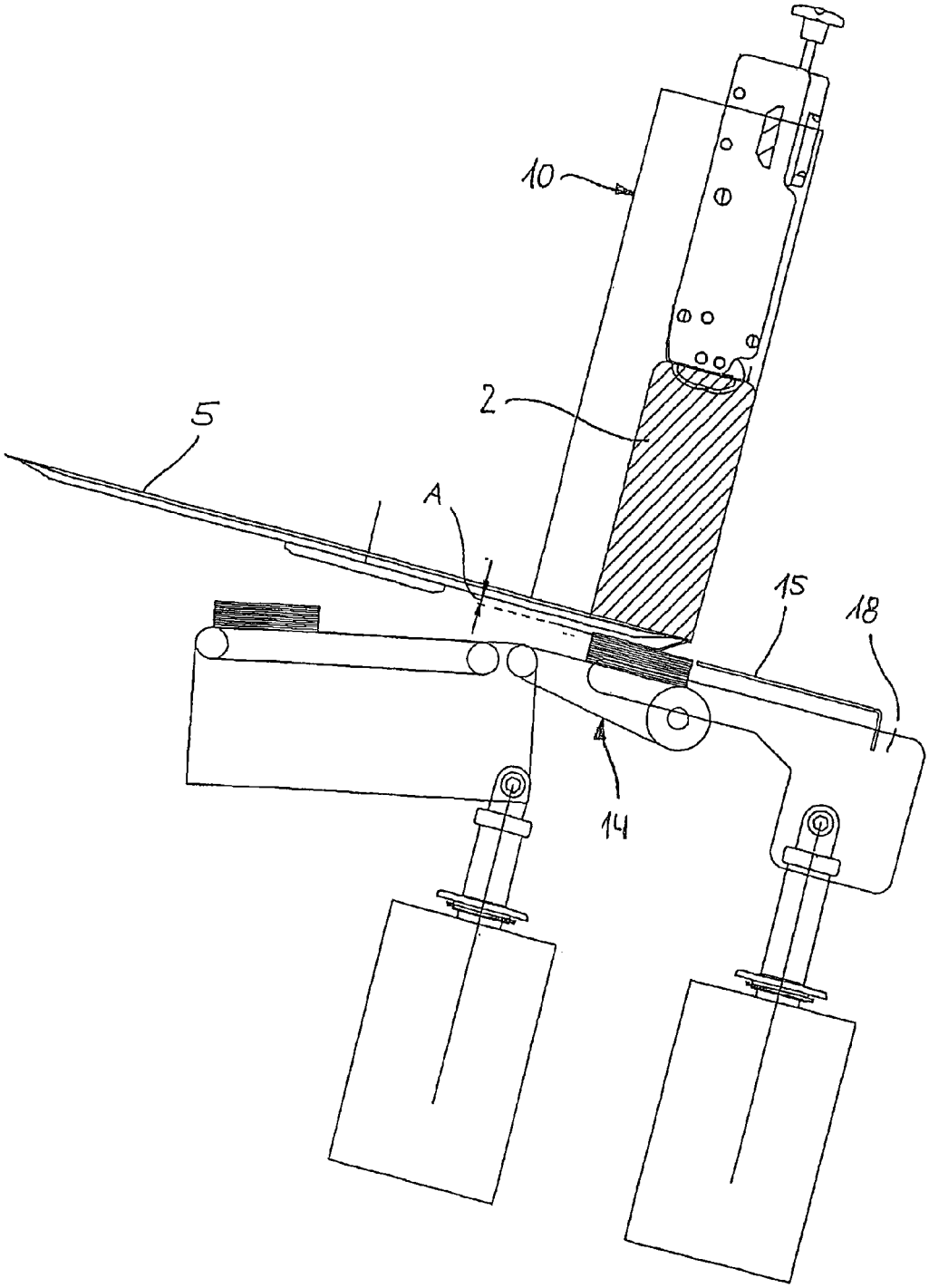
FIG. 12 illustrates a view according to FIG. 11, however with the transferred partial portion on the feed device and the intermediary storage device in the idle position.

Now the intermediary storage device 15 can be pulled out of the projection of the cross-section of the food strand 2 in a next step perpendicular to the feed direction (intermediary position c.f. FIG. 5) in order to move in a next step back into the idle position illustrated in FIG. 12. In this position the intermediary storage device 15 can remain until the last slice of the portion being created is cut off and placed onto the stack. As apparent from FIG. 12, the distance A between the bottom side 43 of the blade 5 and the top side 42 of the slice cut off last is the same again as it was before accelerated lowering of the intermediary storage device (FIGS. 6 through 10).

It is essential for the transfer in the illustrated variant of the method according to the invention that the storage conditions are changed, this means a greater distance between the top side 42 of the unfinished portion and the cutting plane is provided in a preliminary manner in that the intermediary storage device 15 quickly penetrates into the conveying device 14 that is standing still in vertical direction. When cutting off the subsequent three slices 10, 11, 12 of the portion to be completed, the storage conditions change while reducing the vertical distance successively so that when storing the n-th, this means the $12^{th}$ slice, the same storage conditions are provided again as they were provided when storing the first nine slices of the portion due to the synchronous movement of food strand 2 and intermediary storage device 15.

Figure 13:
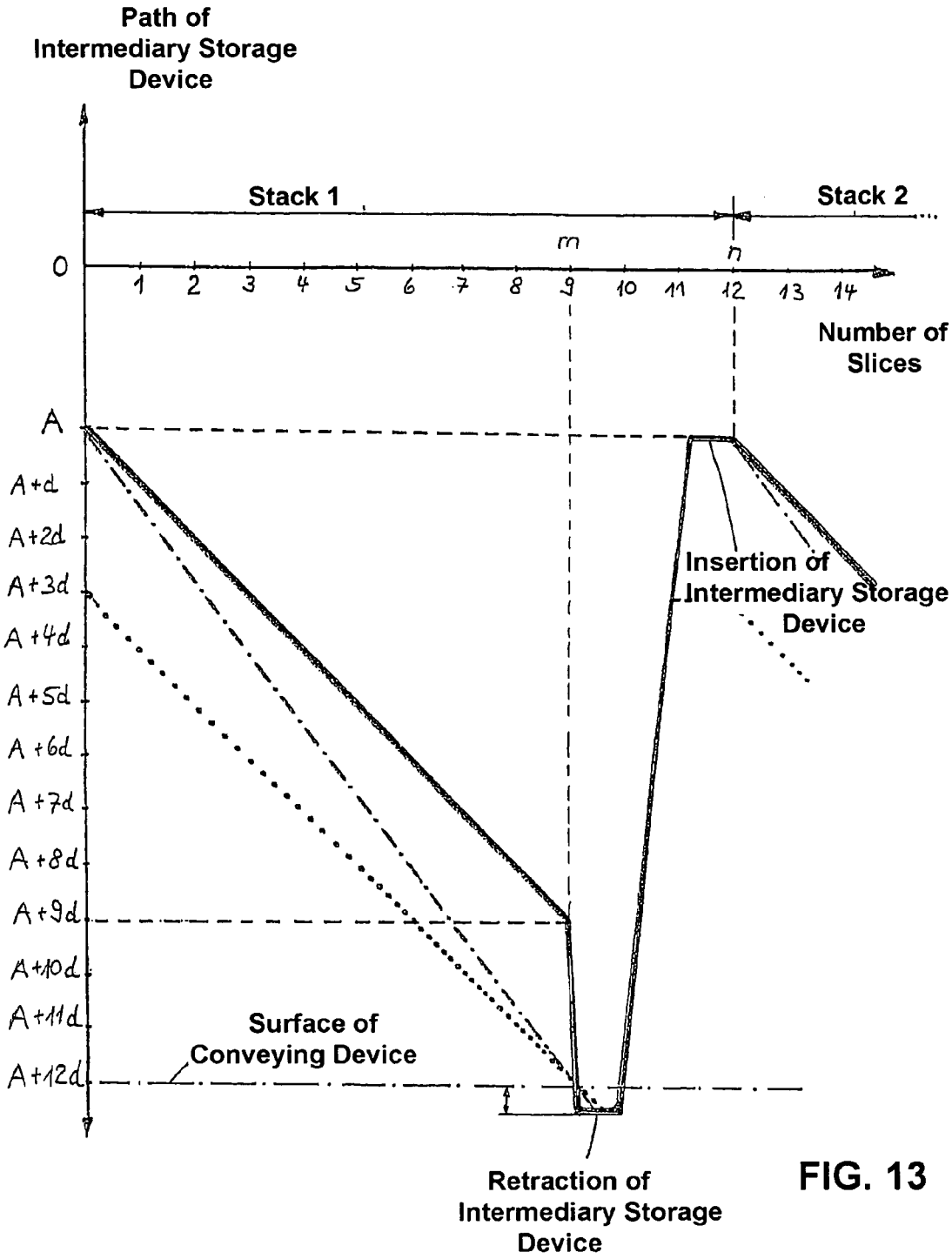
FIG. 13 illustrates a diagram with a depiction of a path of the intermediary storage device over the number of cut off slices.

FIG. 13 furthermore illustrates the path of the lowering travel of the intermediary storage device 15 over the number of cut off slices which is proportional to time due to the blade 5 continuously rotating with identical speed. The diagram with the solid lines illustrates that the intermediary storage device 15 from the beginning of generating a new portion until cutting off the $9^{th}$ slice is continuously lowered with the feed velocity of the material strand. After storing the $9^{th}$ slice a strong increase of the lowering is provided in that the intermediary storage device 15 penetrates the conveying device 14 so that a transfer of the partial portion to the conveying device 14 is provided. The intermediary storage device 15 is not in a supporting function any more from this point in time which is not visible in the diagram in FIG. 13 due to only considering the vertical movement component it can be pulled out in horizontal direction from the cross section of the food strand in order to be quickly moved back into the starting position (idle position) as evident in FIG. 13 in order to be ready for the next insertion.

Figure 14:
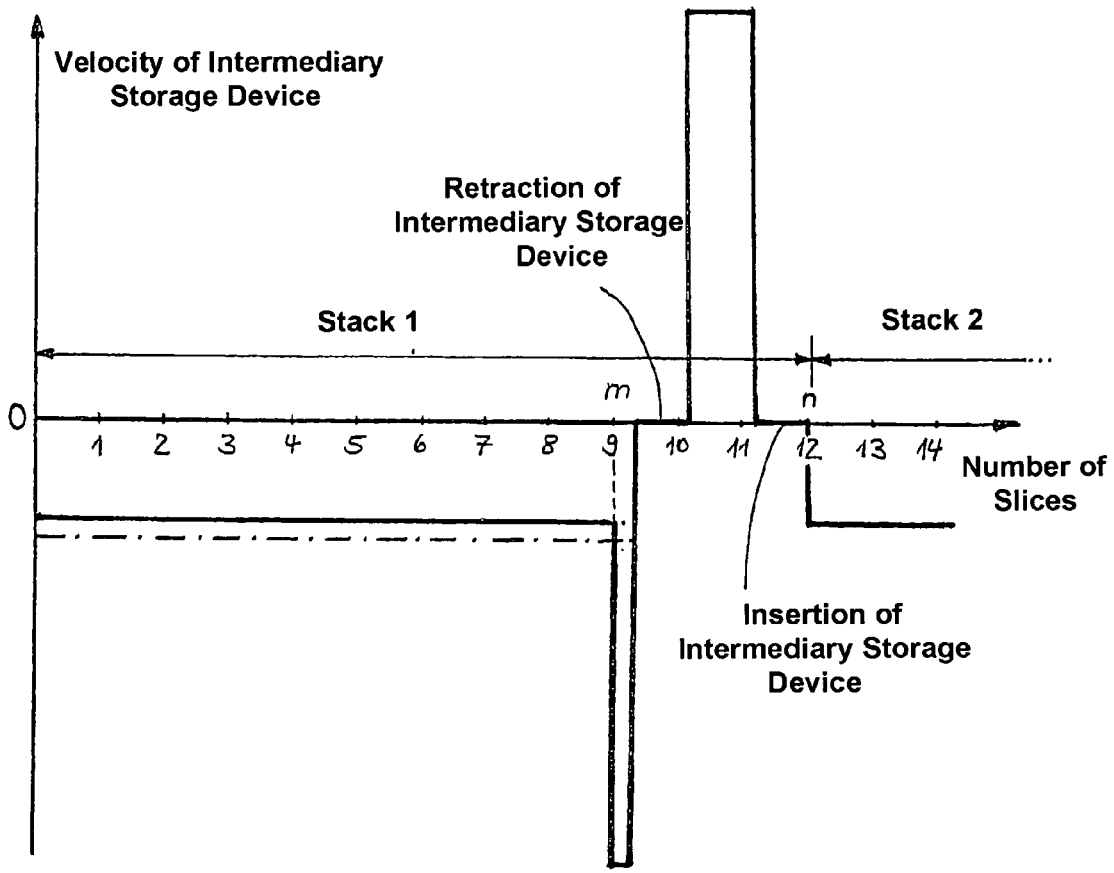
FIG. 14 illustrates a diagram with a representation of the velocity of the intermediary storage device over the number of cut off slices.

FIG. 14 illustrates a diagram in which the curve of the velocity of the intermediary storage device 15 over the cut off slices, this means in turn over time is visible. While cutting off the first 9 slices of a portion the velocity (c.f. solid line) is comparatively small and corresponds to the feed velocity of the food strand 2. After cutting off the $9^{th}$ slice the velocity increases quickly which corresponds to the quick lowering of the intermediary storage device below the level of the feed device. The intermediary storage device 15 then remains in its lowest position for a short period of time wherein it is pulled out in horizontal direction from the cross section of the food strand during this time which is not visible in the diagram. Then there is a quick vertical upward movement which is represented by a high velocity with negative prefix. The cycle terminates with a short phase with a velocity of 0 (in vertical direction), wherein the horizontal insertion of the intermediary storage device 15 however is provided in this phase. Subsequently there is a downward movement of the intermediary storage device 15 according to the forward feed velocity of the food strand 2 which, however, already starts a new cycle.

In FIGS. 13 and 14 two additional variants of the method according to the invention are illustrated in dotted and dash dotted lines.

The dotted line shows that the travel of the intermediary storage device is already by a thickness of 3 slices greater than in the previously described method already at the beginning of the cutting process. As a consequence the travel of the intermediary storage device 15 after cutting off the $9^{th}$ slice is already large enough so that a sufficient buffer distance between the top side 42 of the $9^{th}$ slice and the bottom side 43 of the blade 5 is provided, wherein the last three slices can be stored on the conveying device 14 that is standing still in vertical direction. The accelerated downward movement of the intermediary storage device 15 after storing the $9^{th}$ slice as illustrated in the form of solid lines in FIG. 13 is thus omitted, this means the movements are less dynamic.

The procedure illustrated in dash dotted lines in FIGS. 13 and 14 represents an intermediary path. In this case the distance A is initially like in the case described first, wherein the lowering velocity of the intermediary storage device during the first nine slices is greater than the feed velocity of the material strand, so that during forming the partial stack the "buffer" of distance required after the transfer for the last 3 slices is continuously built up. Also in this case the velocity peak visible in the form of the variant with solid lines when transferring the partial portion to the feed device 14 is omitted. The variant described last thus has the advantage that the distance relative to the variant illustrated in dotted lines is reduced when the cutting process begins, this means when storing the first slice.

REFERENCE NUMERALS AND DESIGNATIONS

1 device
2 food strand
3 cutting device
4 rotation axis
5 blade
6 cutting edge
7 cutting plane
8 longitudinal axis
9 arrow
10 feed device
11 gripper device
12 gripper hook
13 extraction device
14 conveying device
15 intermediary storage device
16 support element
17 support beam
18 receiver frame
19 linear support
20 longitudinal member
21 timing belt
22 double arrow
23 machine frame
24 cylinder
25 piston rod
26 base component
27 cover
28 conveying plane
29 belt
30 deflection roller
31 deflection roller
32 belt
33 deflection roller
34 extraction frame
35 deflection roller
36 cylinder
37 piston rod
38 longitudinal axis
39 receiving element
40 timing belt
41 surface
42 top side
43 bottom side
A distance
m number
n number
d thickness

What is claimed is:

1. A method for cutting a food strand into slices, comprising the steps:

feeding a food strand forward at a feed velocity to a cutting device including a rotating blade;

cutting off successive slices with the cutting device from the food strand at an end of the food strand that is oriented forward in a feed direction during feeding;

placing the cut off slices onto an intermediary storage device that is moveable in a transversal direction to the feed direction and in the feed direction in order to form a non-finished portion which is formed as a stacked or fish scaled slice arrangement with a total of m slices, wherein m is a natural number;

moving the intermediary storage device with the non finished portion away from the cutting device in the feed direction with the feed velocity during forming of the non finished portion;

transferring the non-finished portion from the intermediary storage device to a conveying device;

completing the non-finished portion on the conveying device by cutting off and adding at least one additional slice to the non finished portion to form a finished portion which is formed as a stacked or fish scaled slice arrangement with a total of n slices, wherein n is a natural number greater or equal to three and n>m;

successively reducing a distance between a top side of the non finished portion and a bottom side of the rotating blade with each slice added to the m slices when completing the non-finished portion to form the finished portion on the conveying device; and extracting the finished portion through the conveying device.

2. The method according to claim 1, moving the intermediary storage device with the m slices stored thereon away from the cutting device with a velocity that is greater than the feed velocity of the food strand, and wherein a distance between the bottom side of the blade of the cutting device and a top surface of the m slices when transferring the non-finished portion from the intermediary storage device to the conveying device is greater than a distance between the bottom side of the blade of the cutting device and a top surface of the m slices during cutting off the m slices.

3. The method according to claim 2, wherein the intermediary storage device is moved so that the distance between the bottom side of the blade and the top side of the m slices is greater than the distance between the bottom side of the blade and the top side of the at least one additional slice.

4. The method according to claim 3, wherein the distance between the top side of the intermediary storage device and the bottom side of the blade is increased while cutting off the m slices.

5. The method according to claim 4, wherein a second distance between the blade of the cutting device and a surface of the conveying device is adjusted before a beginning of the cutting process as a function of the number n of the slices of the portion to be generated and a thickness of the particular slices.

6. The method according to claim 5, wherein the number n of the slices of a completed portion is greater by 3 than the number m of the slices of a non-finished portion when the non-finished portion is transferred from the intermediary storage device to the feed device.

7. The method according to claim 6, wherein support elements of the intermediary storage device when transferring the cut off slices from the intermediary storage device to the conveying device enter into intermediary spaces between adjacent belts of the conveying device, and wherein a surface of the support elements supporting the slices is arranged after the transfer below a surface of the belts of the conveying device supporting the slices.

8. The method according to claim 7, including the steps:

moving the intermediary storage device along a closed path which includes linear movement sections, starting the intermediary storage device from an idle position in which the intermediary storage device is arranged outside of a projection of a cross section of the food strand into a plane that is orthogonal to a longitudinal axis of the food strand and includes the surface of the support elements, moving the intermediary storage device substantially parallel to the plane into a first receiving position in which a first slice of a new portion is received, moving the intermediary storage device moved into subsequent receiving positions for generating respective desired storage positions for the slices and for receiving the respective subsequent slice relative to a preceding position in feed direction of the food strand or perpendicular to the feed direction of the food strand, moving the intermediary storage device into an emptying position after receiving the m slices in which emptying position the intermediary storage device and the conveying device viewed in feed direction have moved relative to one another so that the slices have lost contact with the surface of the support elements and instead have come into contact with a surface of belts of the conveying device, and eventually moving the intermediary storage device back into the idle position without contacting a plane of the surface of the belts of the conveying device in a portion of the belts with the support elements.

9. The method according to claim 8, wherein the surface of the support elements of the intermediary storage device in the idle position is in an identical plane with a surface of a last completely cut off slice on the conveying device, and wherein the surface of the last completely cut off slice is oriented towards the food strand.

10. The method according to claim 9, wherein the intermediary storage device only leaves the idle position when the blade has already started to cut off another slice and the blade is already arranged within the cross section of the food strand, wherein the intermediary storage device when moving into the projection of the cross section of the food strand into a plane orthogonal to the feed direction lifts a portion of the slice already being created with a surface of its support elements, and wherein the portion of the slice hangs down due to gravity or contacts a previously cut off slice, and wherein the intermediary storage device penetrates from one side of the food strand into a cross section of the food strand and the blade of the cutting device penetrates from an opposite side of the food stand into the cross section of the food strand.

11. The method according to claim 1, wherein a distance between a top side of the intermediary storage device and the bottom side of the blade is increased while cutting off the m slices.

* * * * *